United States Patent [19]

Kammerer

[11] 4,420,666

[45] Dec. 13, 1983

[54] ELECTRICAL KEY CONTACT

[75] Inventor: Gerd Kammerer, St. Georgen, Fed. Rep. of Germany

[73] Assignee: Dieter Graesslin Feinwerktechnik, St. Georgen, Fed. Rep. of Germany

[21] Appl. No.: 270,312

[22] Filed: Jun. 4, 1981

[51] Int. Cl.[3] ..... H01H 9/18; H01H 13/14

[52] U.S. Cl. ..... 200/340; 200/5 A; 200/308; 235/145 R

[58] Field of Search ..... 340/365 R; 235/145 R; 200/5A, 340; 400/490; 200/308

[56] References Cited

U.S. PATENT DOCUMENTS

| | | | |
|---|---|---|---|
| 1,337,217 | 4/1920 | Gillingham | 200/5 A |
| 2,459,862 | 1/1949 | Avery | 235/145 R |
| 4,024,368 | 5/1977 | Shattuck | 200/340 |
| 4,128,889 | 12/1978 | Ojma et al. | 200/5 A |
| 4,184,321 | 1/1980 | Tarusawa | 200/5 A |
| 4,292,510 | 9/1981 | Hild | 235/145 R |

FOREIGN PATENT DOCUMENTS

| | | | |
|---|---|---|---|
| 2355367 | 1/1978 | France | 200/340 |

*Primary Examiner*—John W. Shepperd

*Attorney, Agent, or Firm*—Flynn, Thiel, Boutell & Tanis

[57] ABSTRACT

A key contact set includes a plurality of electrical key contacts having key buttons, and includes a cover plate with a plurality of key openings through which the respective key buttons project. The key openings and the key buttons each have the shape of a segment of a circle, an ellipse, or a similarly shaped figure. The marking associated with each key is provided on the cover plate in the complementary segment of the circle, ellipse, or other figure. The portion of the cover plate surrounding each key is preferably bent forwardly or rearwardly from the main plane of the cover plate to define a curved surface, and each key button preferably is provided with a service surface having substantially the same radius of curvature as the bent portion of the cover plate.

9 Claims, 4 Drawing Figures

ELECTRICAL KEY CONTACT

FIELD OF THE INVENTION

This invention relates to an electrical key contact which includes a key button and includes a cover plate which has an opening through which the key button projects.

BACKGROUND OF THE INVENTION

During the design of key contact sets or key pads for data input, it is desirable to arrange the necessary buttons for operating the key contacts as close as possible to one another, so that the key contact set can be held as small as possible or, for a given surface of the key contact set, key buttons which are as large as possible can be used. This can be achieved if one applies the markings for the keys on the key buttons themselves. However, applying the markings to the buttons has the disadvantage that, during the assembly of the key contact set, as many differently marked key buttons must be ready as different markings exist. Furthermore, applying the markings directly on the key buttons has the disadvantage that the markings lose sharpness and recognizability, due to constant touching of the key buttons. For this reason, the markings are often applied next to the key buttons on the cover plate. In this case, it is necessary, during the assembly of the key set, to have only one type of key button ready. Since, however, the association of the markings and the associated key buttons must be clear and easily recognizable, this type of marking demands a relatively large spacing between the control buttons.

A basic purpose of the invention is to develop an electrical key contact of the above-mentioned type, a plurality of which can lie closely side-by-side in a key contact set without the need for the key buttons to carry a marking themselves.

SUMMARY OF THE INVENTION

To attain this purpose, an electrical key contact apparatus of the fore-going type is provided, in which the key opening in the cover plate and the cross section of the key button have the shape of a circular segment, an elliptical segment, or a similarly shaped segment.

Due to the fact that the key button and the key opening have a circular-segment or similar shape, the complementary circular segment or similar segment which is located in the cover plate can be used for marking the key. From this results, in a key contact set, an optically clear association of the marking with the associated key. This association impression is further reinforced by the bending out or in of the area of the cover plate which surrounds the control key. Due to the invention, it is possible for the key buttons to be arranged, in a contact set, very closely side-by-side without doubts being created concerning the association of the key buttons and the markings on the cover plate which are printed or are applied in another manner. The danger of a gradual rubbing off of the markings by operator fingers also does not exist.

BRIEF DESCRIPTION OF THE DRAWINGS

The invention is discussed in greater detail in connection with the exemplary embodiments illustrated in the figures.

In the drawings.

DETAILED DESCRIPTION

Figure 1:
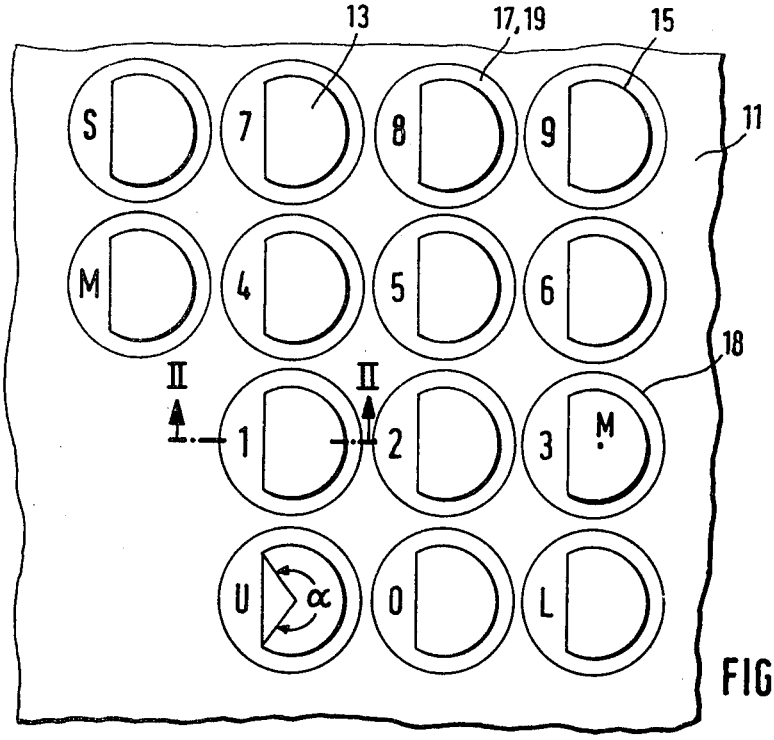
FIG. 1 is a top view of a key set with key contacts according to the invention.
Figure 2:
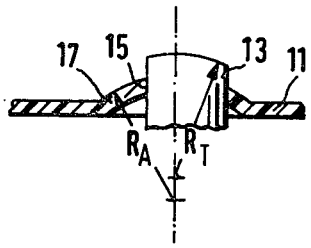
FIG. 2 is a sectional view taken along line II—II of FIG. 1 illustrating the upper part of a key button and the adjacent part of a cover plate.

FIG. 1 shows, in the cover plate 11 which is illustrated, broken-out openings 15 for fourteen key buttons 13 which lie side-by-side in rows. The cross section of the key buttons and the key openings in the cover plate 11 have the shape of a circular segment, whereby the center-point angle $\alpha$ is preferably approximately 250°. The area 17 of the cover plate 11 which lies within a circle 18 around the circle centerpoint M of the circular-segment-shaped opening 15 is, in the embodiment according to FIG. 2, bent forwardly toward the service side, manely, it has a convex, spherical-shaped, arched surface in the illustrated exemplary embodiment. Similarly, in the embodiments according to FIGS. 3 and 4, the area 19 of the cover plate 11 which lies around the opening 15 is bent rearwardly relative to the main plane of the cover plate, namely, it has a concave, spherical-shaped, arched surface in the illustrated exemplary embodiments. This shape of the cover plate, which is illustrated in the figures, makes the association of the markings with the associated keys even more clear. If, as is the case in the exemplary embodiments, the service surface of the key button 13 is also constructed spherical-shaped and the radius $R_T$ of such spherical surface is just as large as the radius $R_A$ of the spherical surface of the forwardly or rearwardly bent area 17 or 19, then optically an impression is gained as if the marking of the key is applied with a lateral offset on a key with circular cross section. The area 17 in FIG. 2 is preferably bent sufficiently far toward the service side from the main plane of the cover plate 11 so that, when the key button 13 is pressed, same forms together with the arched area 17 a uniform spherical surface. The area 19 in FIG. 3 is correspondingly preferably bent rearwardly sufficiently far relative to the main plane of the cover plate 11 so that when the key button 13 is pressed it forms, together with the area 19, a uniform spherical surface.

Figure 4:
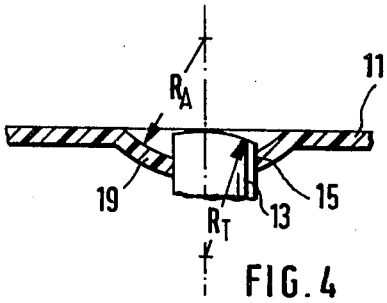
FIGS. 3 to 4 are sectional views similar to FIG. 2 illustrating two further embodiments of the key button and surrounding cover plate area.
Figure 3:
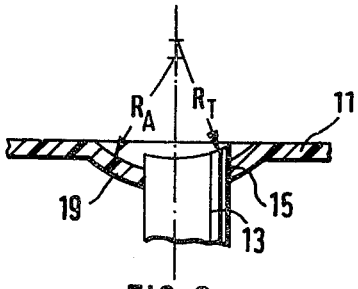

In the embodiments according to FIGS. 3 and 4, the key buttons do not project beyond the main plane of the cover plate 11 when they are not pressed, so that they each lie completely in a protective recess.

During construction of a key contact set with the key contacts according to the invention, it is possible to print the markings on the cover plate 11 and, to equip the cover plate 11, only a single push button type without any markings is necessary. As is shown in FIG. 1, and in spite of the relatively close side-by-side arrangement of the key buttons, a completely clear association of the markings with the keys exists. This association can be emphasized even more clearly by structuring the individual surface areas differently. For example, the key buttons 13 and the areas 17 and 19 which surround the key buttons and which are bent forwardly or rearwardly can be designed with a high shine, while the remaining areas of the cover plate 11 can be provided with a nonshiny surface.

It is to be understood that the key buttons 13 which are illustrated in the figures and the key openings 15 do not necessarily need to be circular-segment-shaped. The circular segments can also be changed to elliptical segments or could have any similar form. The same is true for the areas 17 or 19 which surround the key buttons and which are bent forwardly or rearwardly. Of course, the forwardly or rearwardly bent areas 17 or 19 do not need to have an arched form. Also, it is conceivable that they could project with surfaces perpendicular to the cover plate 11 from same or into same. Furthermore, the arch of the surfaces of the key buttons 13 and/or of the forwardly or rearwardly bent areas 17 and 19, which surfaces point in the service direction, can be constructed to deepen toward the center.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a key pad apparatus which includes a generally planar cover plate having an opening therethrough, electrical switch means supported on one side of said cover plate and having a key button which is supported for movement in directions generally perpendicular to said cover plate, projects through said opening therein, and has a cross section substantially coincident in size and shape with said opening, movement of said key button effecting operation of said switch means, and means defining indicia near said key button on the side of said cover plate opposite said one side, the improvement comprising wherein said cover plate has first and second regions which each have the shape of a closed geometric figure, said second region being a portion of, having a size slightly smaller than, and being substantially centered in said first region and being defined by complementary first and second portions, the perimeters of said first and second portions each having a portion which is coincident with a respective portion of said closed geometric figure which bounds said second region, said opening through said cover plate and said first portion of said second region thereof being coincident, said first region of said cover plate being curved and lying out of the plane of said cover plate, and said indicia being provided within said second portion of said second region.

2. The key pad apparatus of claim 1, wherein said first and second regions of said key pad are concentric circular regions, and wherein said first and second portions of said second region are defined by a line extending across said second region.

3. The key pad apparatus of claim 2, wherein said first portion of said second region is a segment of a circle having a central angle which is greater than 180°.

4. The key pad apparatus of claim 3, wherein said central angle is between 200° and 280°.

5. The key pad apparatus of claim 2, wherein said curved first region is, on the side of said cover plate remote from said switch means, of convex, approximately hemispherical shape.

6. The key pad apparatus of claim 2, wherein said curved first region is, on the side of said cover plate remote from said switch means, of concave, approximately hemispherical shape.

7. The key pad apparatus of claim 5 or claim 6, wherein a surface provided at the end of said key button remote from said switch means is a portion of a spherical surface.

8. The key pad apparatus of claim 7, wherein the radius of said spherical surface on said key button is substantially equal to the radius of said first region of said cover plate.

9. The key pad apparatus of claim 2, including a plurality of said openings in said cover plate which each have respective said first and second regions of said cover plate associated therewith, including a plurality of said switch means which each have a said key button which projects through a respective said opening in said cover plate, and wherein all of said openings and said key buttons have the same angular orientation.

* * * * *